US008265496B2

(12) United States Patent
Sumii

(10) Patent No.: US 8,265,496 B2
(45) Date of Patent: Sep. 11, 2012

(54) IMAGE FORMING APPARATUS FEATURTING A TONER CONTAINER INCLUDING A PLURALITY OF TONER CONVEYING MEMBERS AND A TONER SENSOR

(75) Inventor: Mika Sumii, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 530 days.

(21) Appl. No.: 12/496,894

(22) Filed: Jul. 2, 2009

(65) Prior Publication Data

US 2010/0021212 A1 Jan. 28, 2010

(30) Foreign Application Priority Data

Jul. 24, 2008 (JP) ..... 2008-190888

(51) Int. Cl.
*G03G 21/12* (2006.01)

(52) U.S. Cl. ..... 399/35; 399/120; 399/262; 399/358; 399/360

(58) Field of Classification Search ..... 399/35, 399/360
See application file for complete search history.

(56) References Cited

U.S. PATENT DOCUMENTS

| | | | | |
|---|---|---|---|---|
| 5,835,837 | A * | 11/1998 | Saitoh et al. | 399/343 |
| 5,887,224 | A * | 3/1999 | Mizuishi et al. | 399/62 |
| 6,081,676 | A * | 6/2000 | Inomata | 399/25 |
| 6,298,217 | B1 * | 10/2001 | Murayama et al. | 399/358 |
| 7,623,820 | B2 * | 11/2009 | Nada et al. | 399/358 |
| 7,634,221 | B2 * | 12/2009 | Kudo | 399/360 |
| 7,660,541 | B2 * | 2/2010 | Tanimoto et al. | 399/35 |
| 7,764,919 | B2 * | 7/2010 | Lim | 399/360 |
| 7,991,344 | B2 * | 8/2011 | Naruse | 399/358 |
| RE42,797 | E * | 10/2011 | Makino | 399/258 |
| 8,090,307 | B2 * | 1/2012 | Hoshino et al. | 399/358 |
| 8,131,183 | B2 * | 3/2012 | Ito | 399/120 |
| 2006/0039710 | A1 * | 2/2006 | Tawada | 399/35 |
| 2007/0065166 | A1 * | 3/2007 | Takiguchi et al. | 399/35 |
| 2007/0147859 | A1 | 6/2007 | Adachi et al. | |
| 2007/0242993 | A1 * | 10/2007 | Tanaka | 399/358 |
| 2009/0226205 | A1 * | 9/2009 | Sato et al. | 399/101 |
| 2010/0111582 | A1 * | 5/2010 | Nishimura et al. | 399/360 |
| 2011/0091227 | A1 * | 4/2011 | Tomita et al. | 399/35 |
| 2011/0243584 | A1 * | 10/2011 | Fukuda | 399/30 |
| 2012/0014728 | A1 * | 1/2012 | Karasawa et al. | 399/360 |

FOREIGN PATENT DOCUMENTS

| | | |
|---|---|---|
| JP | 2006-98743 A | 4/2006 |
| JP | 2007-178947 A | 7/2007 |

* cited by examiner

*Primary Examiner* — David Gray
*Assistant Examiner* — Geoffrey Evans
(74) *Attorney, Agent, or Firm* — Fitzpatrick, Cella, Harper & Scinto

(57) ABSTRACT

There is provided an image forming apparatus including a casing in which toner is accommodated, a toner inflow portion that is provided on a side of one of ends in a longitudinal direction of the casing, a first screw that conveys the toner accommodated in the casing from one end toward the other end, a second screw that conveys the toner accommodated in the casing from the other end toward one end, and a sensor in which a detection portion is disposed at a position facing a side face of the casing provided in the longitudinal direction in order to detect an amount of toner accommodated in the casing. The longitudinal direction of the detection portion is located closer to one end than the other end, and a position in a vertical direction of the detection portion partially overlaps at least a toner conveying region of the second screw.

2 Claims, 9 Drawing Sheets

IMAGE FORMING APPARATUS FEATURTING A TONER CONTAINER INCLUDING A PLURALITY OF TONER CONVEYING MEMBERS AND A TONER SENSOR

BACKGROUND OF THE INVENTION

1. Field of the Invention

The present invention relates to an image forming apparatus including a recover toner box in which recovered toner is accommodated.

2. Description of the Related Art

There is well known a technique of recovering the toner remaining on a surface of an image bearing member such as a photosensitive drum and an intermediate transfer belt after transfer in order to accommodate the recovered toner in a toner box. The toner box is exchangeably placed in the image forming apparatus. A toner detecting sensor is provided in the toner box in order to detect an amount of toner accumulated in the toner box. The toner detecting sensor detects that the toner box is filled up with the accumulated toner, whereby a user can recognize an exchange time of the toner box.

However, simply accommodating the toner in the toner box through an inflow port provided in the toner box accumulates the toner in a chevron shape with a peak of the inflow port. Even if the toner detecting sensor detects an uppermost portion of the toner accumulated in the chevron shape, the toner detecting sensor detects that the toner box is filled up with the toner although the toner box has an accommodation space.

Therefore, for example, in a technique disclosed in Japanese Patent Application Laid-Open No. 2006-98743 (FIG. 1, FIG. 2, FIG. 3), the toner detecting sensor detects the toner box is filled up with the toner after the uppermost portion of the toner accumulated in the toner box is flattened using two screws that convey the toner in opposite directions to each other.

However, in the toner box disclosed in Japanese Patent Application Laid-Open No. 2006-98743, the toner detecting sensor performs the detection on an end side of a container far away from the inflow port and in a detection space provided higher than a screw agitation region. In the configuration of the toner box disclosed in Japanese Patent Application Laid-Open No. 2006-98743, the toner entering the toner box through the inflow port is first accumulated on the inflow port side in a longitudinal direction of the container. The toner accumulated up to a level of one of the screws is gradually conveyed toward the side far away from the inflow port by one of the screws, and the toner is spread in the container. When the accumulation of the toner reaches the far side, the toner accumulated up to a level of the other screw which conveys in the opposite direction is conveyed toward the inflow port by the other screw. The accumulation of the toner is spread toward the inflow port side while an empty space in the container is filled with toner. In the configuration of the container, when the toner detecting sensor is provided on the end side of the container far away from the inflow port, the toner detecting sensor detects the toner before the toner is spread over the whole space by the other screw, and a determination that the container is filled up with the toner is made although the container can still accommodate the toner. When the toner detecting sensor is provided above the screw agitation region, the toner is accumulated higher than the screw, the toner excessively burdens the screw, and possibly the screw is locked.

Therefore, in order to prevent the screw lock, a full space detecting sensor is disposed while facing a side portion of the turndown screw. Further, the full space detecting sensor is disposed on a downstream side in a conveying direction of the turndown screw, which allows the full space to be detected after the accumulated toner is spread over the whole container.

However, the following problem is generated when the full space detecting sensor is disposed at the position in the container having the turndown screw. As disclosed in Japanese Patent Application Laid-Open No. 2006-98743, in the case of the turndown conveyance, the toner is accumulated from a front side of the container and, at the same time, the toner is returned by the turndown screw. At this point, the toner near an entrance is returned to a sensor detection portion. Therefore, before the toner is spread over the whole container, the toner is accumulated in the sensor facing portion, and sometimes the sensor detection portion falsely detects that the container is filled up with the toner.

SUMMARY OF THE INVENTION

An object of the invention is to provide an image forming apparatus in which, before a recover container that conveys the toner in a turndown manner is filled up with the toner, the toner can be prevented from being conveyed and accumulated in a sensor facing portion by a simple configuration while the recover space is effectively utilized.

According to an aspect of the invention, there is provided an image forming apparatus including an image forming portion that forms a toner image; a container that is detachably attached to the image forming apparatus main body to accommodate toner discharged from the image forming portion; an inflow port that is provided on a side of one end in a longitudinal direction of the container, the toner discharged from the image forming portion being caused to flow in the container through the inflow port; a first conveying member that is provided in the container, the first conveying member including a conveying portion that conveys the toner flowing through the inflow port from the one end toward the other end; a second conveying member that is provided in the container so as to be adjacent to the first conveying member in a horizontal direction, the second conveying member including a conveying portion that conveys the toner accommodated in the container from the other end toward the one end; and a sensor that detects the toner accommodated in the container, wherein the sensor is provided so as to face a side portion on a downstream side in a conveying direction of the second conveying member, and the conveying portion of the second conveying member is provided while avoiding at least a facing portion that faces the sensor.

Further features of the present invention will become apparent from the following description of exemplary embodiments with reference to the attached drawings.

DESCRIPTION OF THE EMBODIMENTS

An exemplary embodiment of the invention will be described below with reference to the drawings. Dimensions, materials, shapes, and a relative disposition of components described in the following embodiment should appropriately be changed according to a configuration or various conditions of an apparatus to which the invention is applied. Accordingly, the invention is not limited to those of the components described in the embodiment unless otherwise noted.

An image forming apparatus including a detachably attachable recover toner box will be described by way of example. First, a schematic configuration of the image forming apparatus is described, and then a configuration of the recover toner box is described.

Figure 1:
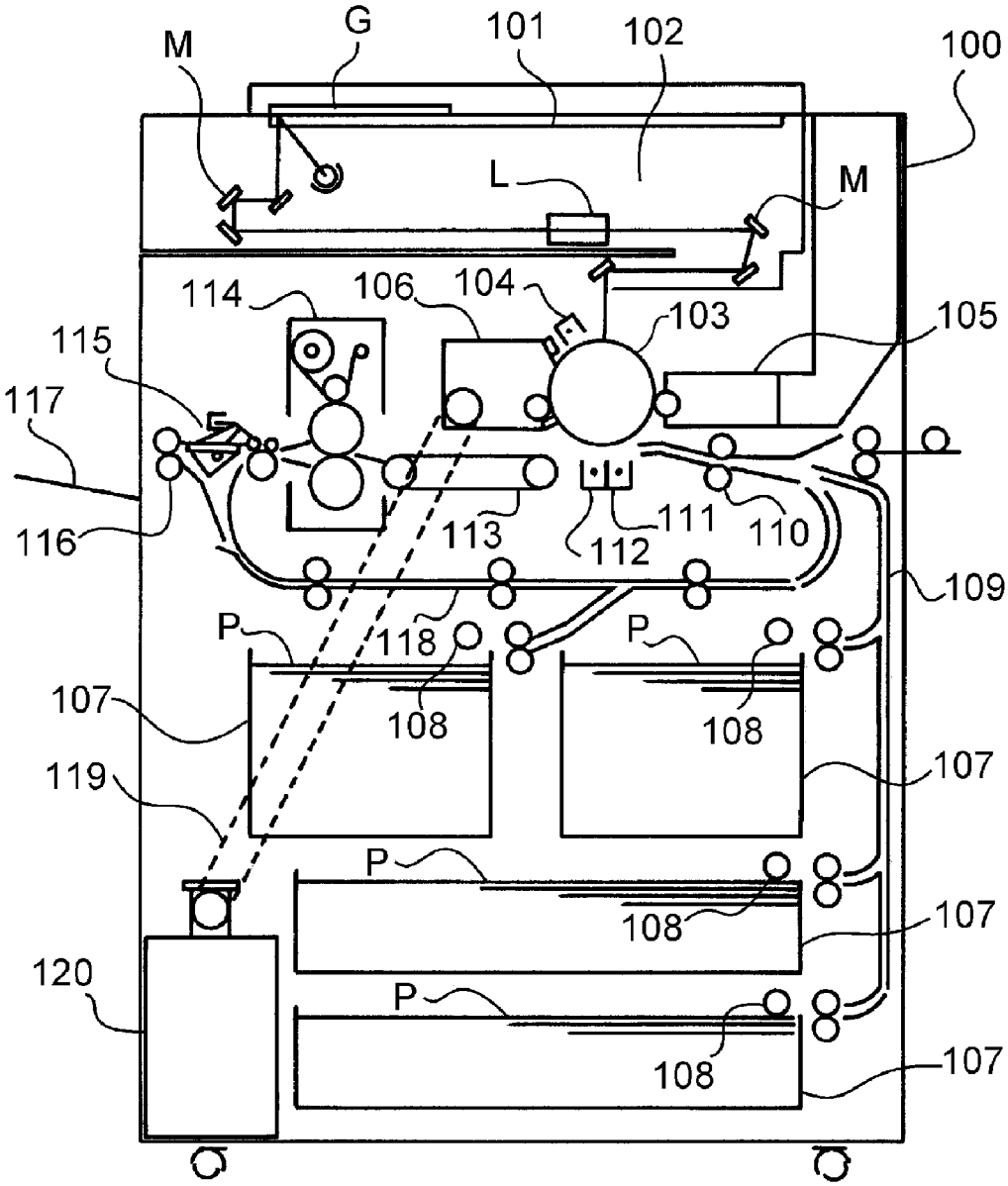
FIG. 1 is a sectional view illustrating a schematic configuration of an image forming apparatus.

The schematic configuration of the image forming apparatus will be described with reference to FIG. 1. FIG. 1 is a sectional view illustrating the image forming apparatus including the recover toner box. Referring to FIG. 1, in an image forming apparatus main body (hereinafter referred to as apparatus main body) 100, an original G is placed on an original base plate glass 101, and an optical image corresponding to image information is formed on an electrophotographic photosensitive drum (hereinafter referred to as photosensitive drum) 103 that is of an image bearing member by a plurality of mirrors M and a lens L of an optical unit (exposure device) 102.

A primary charger (charging device) 104, a development device 105, and cleaning device 106 are disposed around the photosensitive drum 103. The optical image corresponding to the image information is formed on the photosensitive drum 103 charged by the primary charger 104, thereby forming an electrostatic latent image. The development device 105 develops the electrostatic latent image formed on the photosensitive drum 103 using toner. The cleaning device 106 recovers the toner remaining on the photosensitive drum 103 after transfer. The image bearing member, the charging device, the exposure device, the development device, and the cleaning device constitutes an image forming portion that forms the toner image on the image bearing member. The toner recovered by the cleaning device 106 is discharged to a recover toner box 120 through a recover toner pipe 119 and accommodated in a toner box.

On the other hand, one recording medium P selectively fed from a plurality of cassettes 107 by a feeding device 108 is conveyed to a registration roller 110 through a conveying passage 109. The registration roller 110 conveys the recording medium P to a transfer portion in synchronization with rotation of the photosensitive drum 103 and scanning of the optical unit 102. In the transfer portion, a transfer discharger (transfer device) 111 transfers the toner image formed on the photosensitive drum 103 to the recording medium P. A separation discharger 112 separates the recording medium P to which the toner image is transferred from the photosensitive drum 103.

Then, a conveying device 113 conveys the recording medium P to a fixing device 114, and the fixing device 114 fixes the toner image to the recording medium P by heat and pressure. After the fixing, in the case of single-sided copy, a discharge roller 116 discharges the recording medium P through a reverse discharge device 115 to a discharge tray 117. In the case of double-sided or multiple copy, the recording medium P is delivered to a re-feed conveying device 118 by the reverse discharge device 115, the recording medium P is passed through the registration roller 110, and the recording medium P is discharged to the discharge tray 117 through the same path as that of the single-sided copy.

The recover toner box 120 will be described with reference to FIGS. 2 to 10. The recover toner box 120 is detachably attached to the image forming apparatus main body 100. The recover toner box 120 is disposed along a longitudinal direction in a lower portion of the image forming apparatus.

Figure 2A:
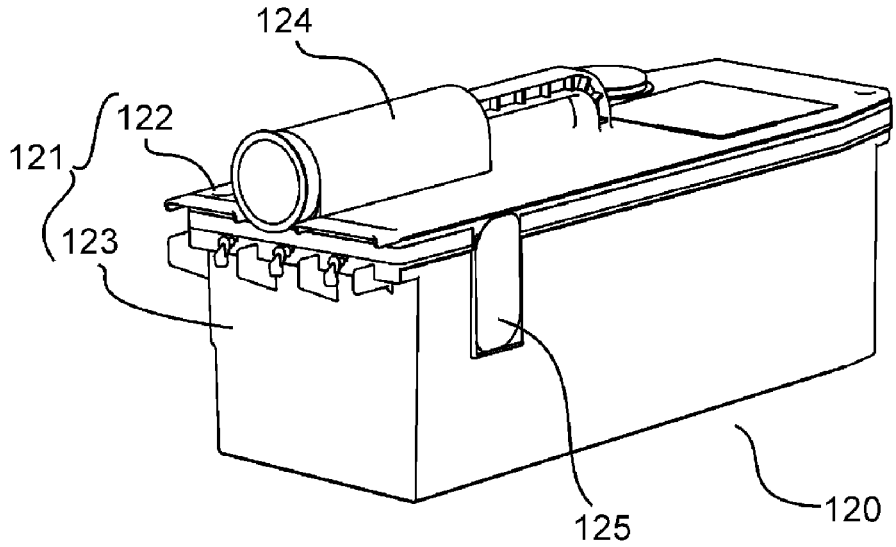
FIGS. 2A and 2B are perspective views of a recover toner box.
Figure 2B:
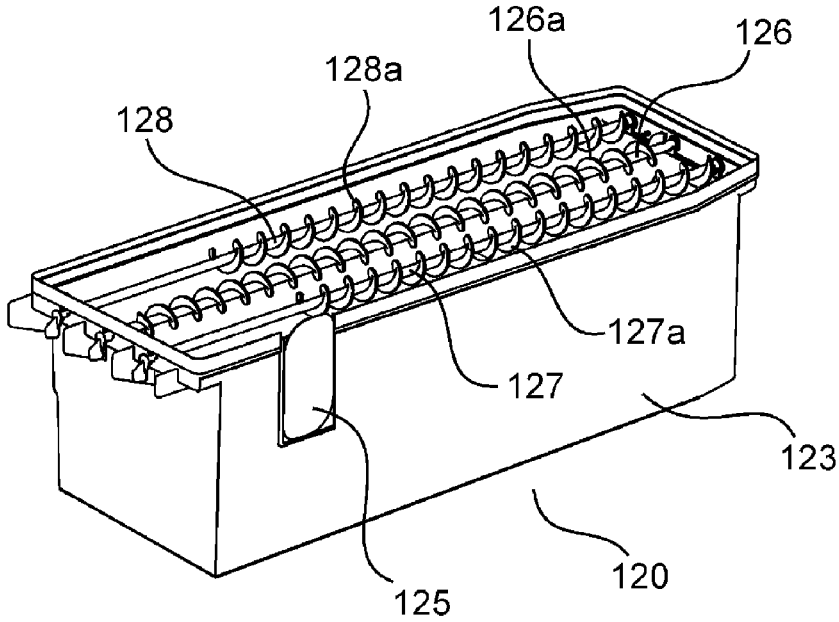

FIG. 2 is a perspective view illustrating the configuration of the recover toner box. The recover toner box 120 includes a casing (hereinafter also referred to as container) 121. The casing 121 is a container that accommodates the toner recovered from the image forming apparatus therein. The casing 121 includes an upper casing 122 and a lower casing 123. A toner inflow portion 124 is provided in the upper casing 122, and a toner detecting window 125 is provided in the lower casing 123. The toner inflow portion 124 is used to cause the recovered toner to flow in the casing 121, and the toner inflow portion 124 is provided on one end side in the longitudinal direction of the casing 121. The toner flows in the container from an inflow port 124*a* provided in the toner inflow portion 124.

Figure 3A:
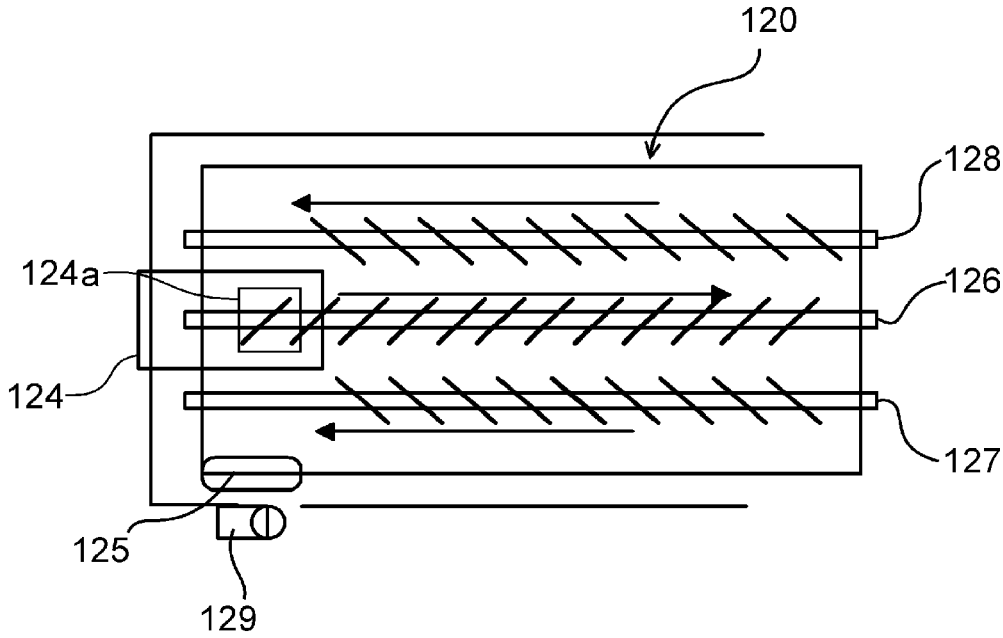
FIG. 3A is a top view of the recover toner box.
Figure 3B:
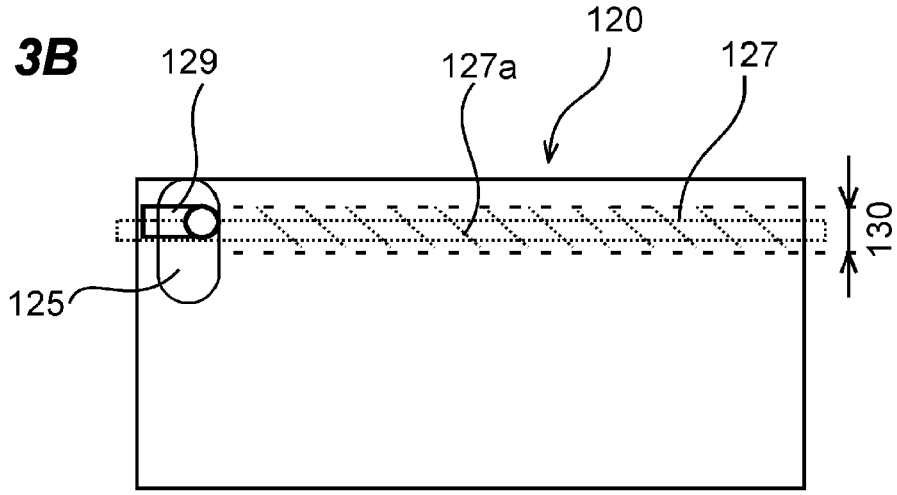
FIG. 3B is a side view of the recover toner box.

The recover toner box 120 includes a conveying member (screws 126, 127, and 128) that conveys the toner accommodated and accumulated in the casing 121 in the longitudinal direction of the casing 121. The first screw 126 is a first conveying member that conveys the toner accumulated in the casing 121 from one end in the longitudinal direction of the casing 121 to the other end. The first screw 126 includes a vane portion (conveying portion) 126*a*, and the first screw 126 is provided near the toner inflow port 124*a*. The vane portion 126*a* conveys the toner along a shaft while agitating the toner. The second screw 127 is a second conveying member that conveys the toner, conveyed and accumulated toward the other end of the casing 121 by the first screw 126, from the other end of the casing 121 toward one end. Similarly, the third screw 128 is a third conveying member that conveys the toner, conveyed and accumulated toward the other end of the casing 121 by the first screw 126, from the other end of the casing 121 toward one end. The second screw 127 and the third screw 128 include vane portions (conveying portion) 127*a* and 128*a* that convey the toner while agitating the toner, respectively. FIG. 3 illustrates a toner conveying direction of each of the screws 126 to 128. FIG. 3A is a schematic top view of the recover toner box, and FIG. 3B is a schematic side view of the recover toner box. The second screw 127 and the third screw 128 have a function of conveying the toner in the opposite direction to the first screw 126. The second screw 127 and the third screw 128 are disposed across the first screw 126 from each other.

As illustrated in FIG. 3, a toner detecting window 125 that detects a toner amount in the container is provided in a side face provided along the longitudinal direction of the recover toner box 120. In order to detect the amount of toner accumulated in the container, a detection portion of a toner detecting sensor (toner detecting unit) 129 is disposed at a position facing the toner detecting window 125. The longitudinal direction of the detection portion of a toner detecting sensor 129 is located on a downstream side in a toner conveying direction of the second screw 127 (position closer to the downstream side (one end) than the upstream side (the other end) of the container). The position in the vertical direction of the detection portion partially overlaps at least a toner conveying region 130 of the second screw 127.

Figures 4A, 4B, 4C:
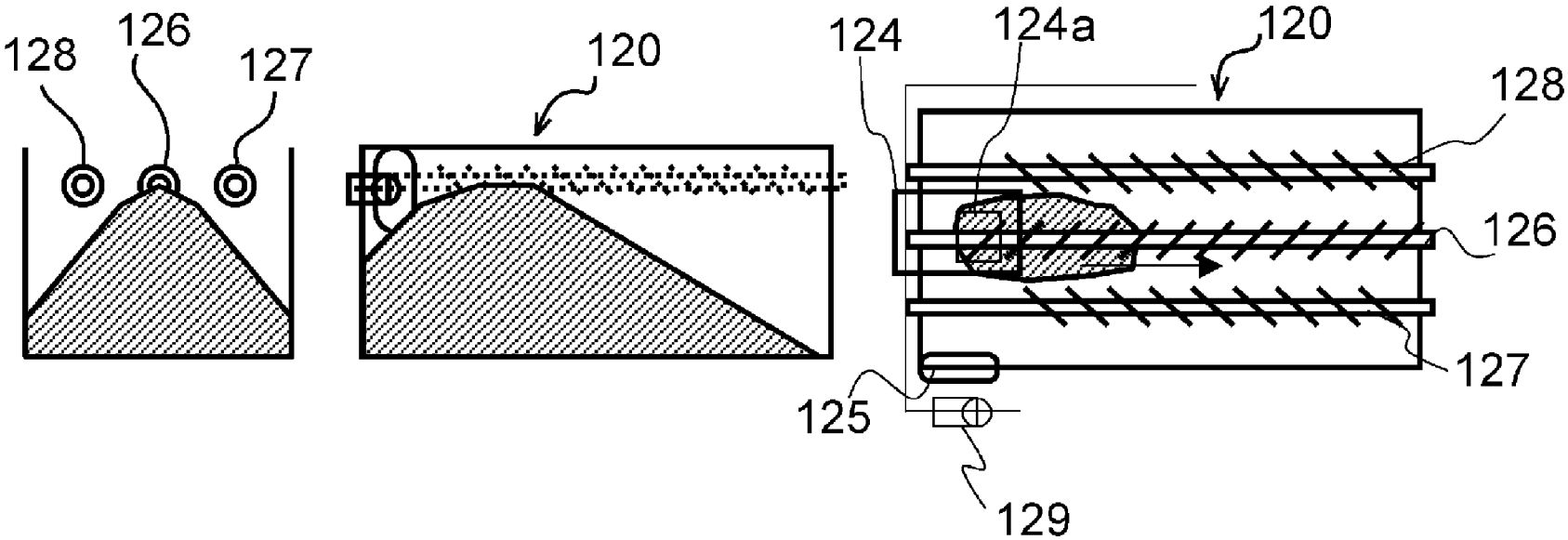
FIG. 4A is a front view of the recover toner box.
FIG. 4B is a side view of the recover toner box.
FIG. 4C is a top view of the recover toner box.
Figures 5A, 5B, 5C:
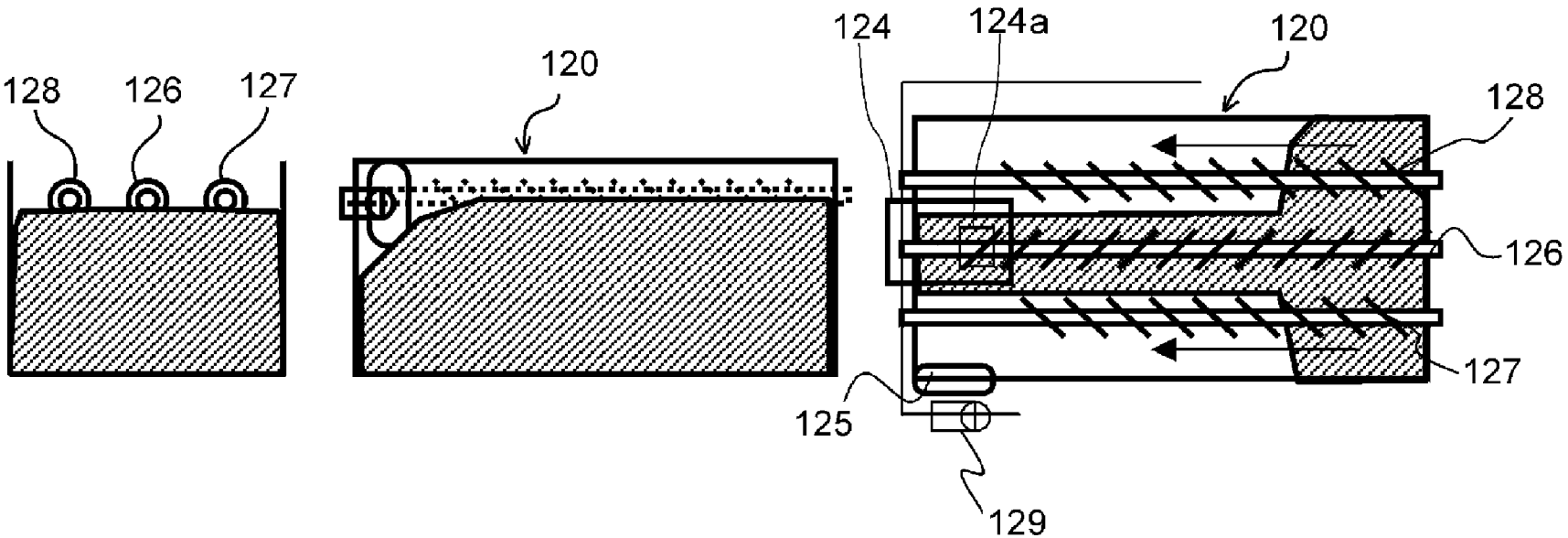
FIG. 5A is a front view of the recover toner box.
FIG. 5B is a side view of the recover toner box.
FIG. 5C is a top view of the recover toner box.
Figures 6A, 6B, 6C:
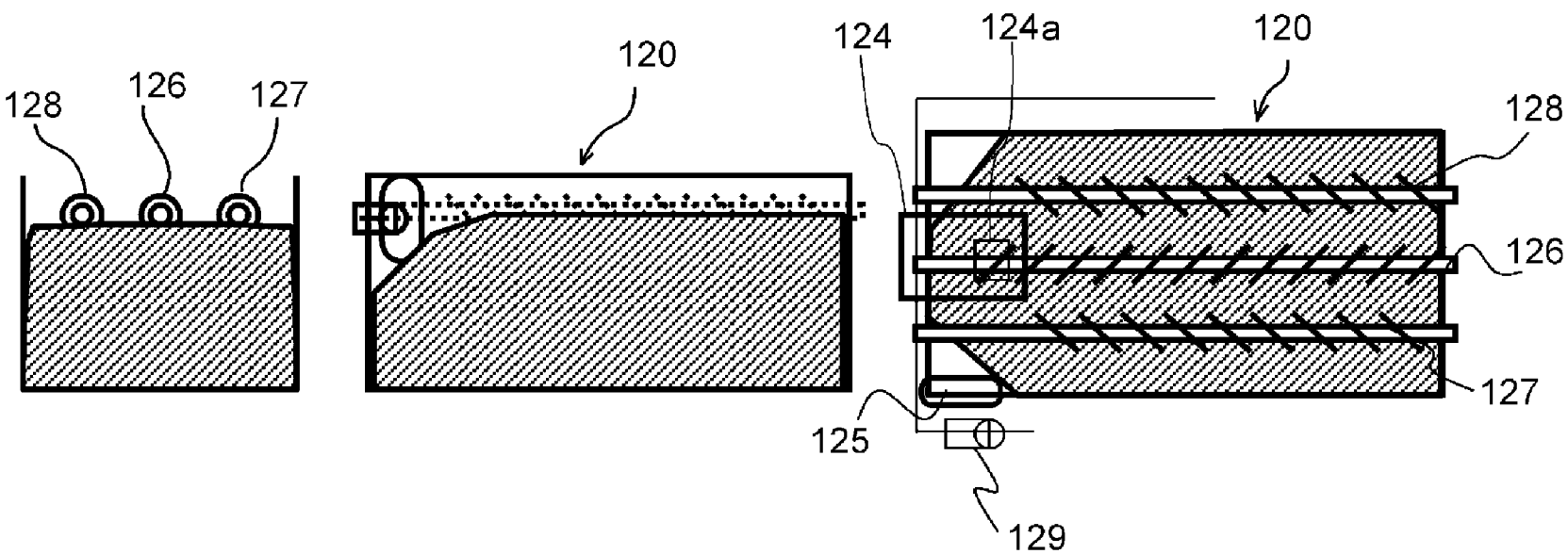
FIG. 6A is a front view of the recover toner box.
FIG. 6B is a side view of the recover toner box.
FIG. 6C is a top view of the recover toner box.

A process for accumulating the toner recovered in the recover toner box 120 will be described with reference to FIGS. 4 to 6. FIGS. 4 to 6 illustrate the process for accumulating the toner in the recover toner box. FIGS. 4A, 5A, and 6A are schematic front views of the recover toner box. FIGS. 4B, 5B, and 6B are schematic side views of the recover toner box. FIGS. 4C, 5C, and 6C are schematic top views of the recover toner box.

In the following description, in the longitudinal direction (axial direction of the screw) of the recover toner box 120, it is assumed that a front side is one end side on which the inflow port 124*a* is provided while a back side is the other end side opposite the side on which the inflow port 124*a* is provided.

As illustrated in FIGS. 4A to 4C, the accumulated toner flowing in the casing 121 through the inflow port 124*a* is conveyed and accumulated from the side of the inflow port 124*a* toward the back side by the first screw 126. Then, as illustrated in FIGS. 5A to 5C, the toner accumulated on the back side is conveyed toward the side of the inflow port 124*a* (front side) by the second screw 127 and the third screw 128. At this point, the toner conveyed by the second screw 127 and third screw 128 is conveyed onto the side of the inflow port 124*a* from the opposite end of the inflow port 124*a* while the casing 121 is filled with the toner up to a level of the screw. Therefore, as illustrated in FIGS. 6A to 6C, finally, the toner can be accumulated in the recover toner box 120 while a container capacity of the recover toner box 120 is effectively utilized.

Referring to FIG. 3, the toner detecting window 125 is provided on the downstream side in the toner conveying direction of the second screw 127, which is of the front side in the longitudinal direction. The second screw 127 includes the vane portion (conveying portion) 127*a* that conveys the toner along the shaft while agitating the toner, and the vane portion 127*a* is not provided at the position facing the toner detecting window 125. That is, although the second screw 127 includes the vane portion 127*a*, the vane portion 127*a* is not provided from the front side of the toner detecting window 125 to a side end of the inflow port 124*a*. Therefore, false detection of the amount of accumulated toner is prevented. The false detection of the amount of accumulated toner is caused by adhesion of the toner to the toner detecting window 125 when the conveying function of the second screw 127 causes the toner to flow.

Further, as illustrated in FIG. 3, the detection portion of the toner detecting sensor 129 is provided outside the casing 121 and at the position contacting the toner detecting window 125. That is, the longitudinal direction of the detection portion of the toner detecting sensor 129 is located closer to the front side in the longitudinal direction of the container than the back side, and the position in the vertical direction of the detection portion partially overlaps at least the toner conveying region 130 of the second screw 127. Therefore, the toner detecting sensor 129 can detect the amount of toner accumulated in the recover toner box 120 before the toner is excessively accumulated over each screw. Accordingly, the full space of accumulated toner can be stably detected without excessively burdening the screws 126, 127, and 128 due to the toner accumulation while the accommodation space of the container of the recover toner box 120 is effectively utilized.

Figure 8:
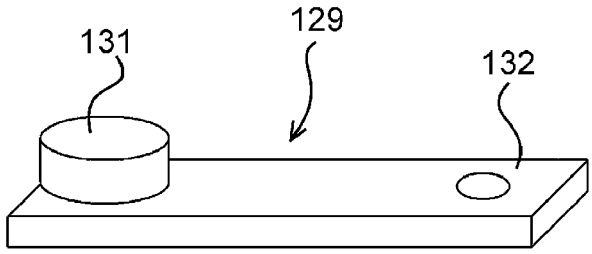
FIG. 8 is a perspective view of a magnetic sensor.

A magnetic sensor is used as the toner detecting sensor 129. As illustrated in FIG. 8, the toner detecting sensor 129 includes a detection portion 131 and a support portion 132. The detection portion 131 has a total length of about 60 mm and a diameter of about 15 mm. The support portion 132 supports the detection portion 131. The magnetic sensor measures a magnetic quantity of the toner, thereby detecting the amount of accumulated toner. The magnetic quantity of the toner is changed according to the toner amount. The magnetic sensor converts the detected magnetic quantity into a voltage, and the magnetic sensor recognizes that the toner is present when detecting a voltage (magnetic quantity) that is equal to or more than a predetermined specified value N.

Figure 7:
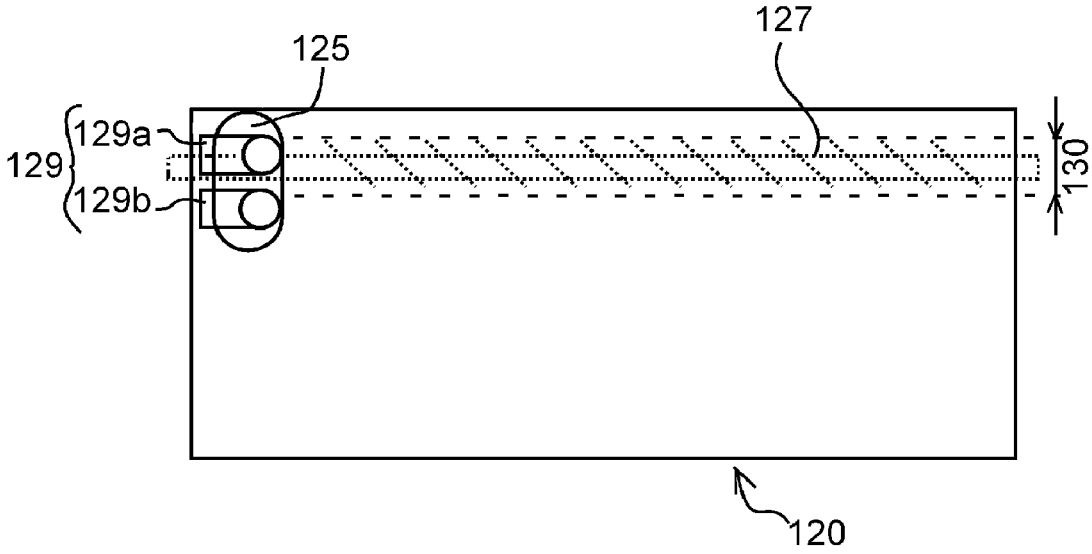
FIG. 7 is a side view of the recover toner box.

At this point, as illustrated in FIG. 7, two magnetic sensors 129*a* and 129*b* are used as the toner detecting sensor 129. The magnetic sensor 129*a* is a full space sensor and detects that the recover toner box 120 is filled up with the toner. The magnetic sensor 129*a* is provided in the toner conveying region 130 of the third screw 128. The magnetic sensor 129*b* is a full space notice sensor and detects that the toner accumulation amount approaches a capacity of the recover toner box 120. The magnetic sensor 129*b* is provided below the magnetic sensor 129*a*. Hereinafter, the magnetic sensor 129*a* and the magnetic sensor 129*b* are referred to as full space sensor and full space notice sensor, respectively.

The full space sensor 129*a* which is one magnetic sensor, is provided while contacting the toner detecting window 125, and a detection portion of the full space sensor 129*a* exists partially in the toner conveying region 130 of the second screw 127. The toner detecting window 125 has a thickness of about 0.3 mm, and the thickness of the toner detecting window 125 is lower than that of the casing 121. Therefore, a distance between the full space sensor 129*a* and a toner surface can be shortened to reduce an error in detecting the toner accumulation amount. When the full space sensor 129*a* detects the voltage (magnetic quantity) that is equal to or more than the predetermined specified value N, the full space sensor 129*a* recognizes that the recover toner box 120 is filled up with the toner, and the information indicating that the recover toner box 120 is filled up with the toner is displayed on an operation portion (not illustrated) of the image forming apparatus.

The full space notice sensor 129*b* which is another magnetic sensor, is provided while contacting the toner detecting window 125 like the full space sensor 129*a*, and the full space sensor 129*b* is located below the full space sensor 129*a* (below the full space sensor 129*a* by several centimeters in the vertical direction). The full space notice sensor 129*b* detects that the toner accumulation amount approaches the capacity of the recover toner box 120 before the detection of the full space sensor 129*a*, and the information indicating that the toner accumulation amount approaches the capacity of the recover toner box 120 is displayed on the operation portion (not illustrated). Therefore, notification that an exchange time of the recover toner box 120 comes close can be made.

Figure 9:
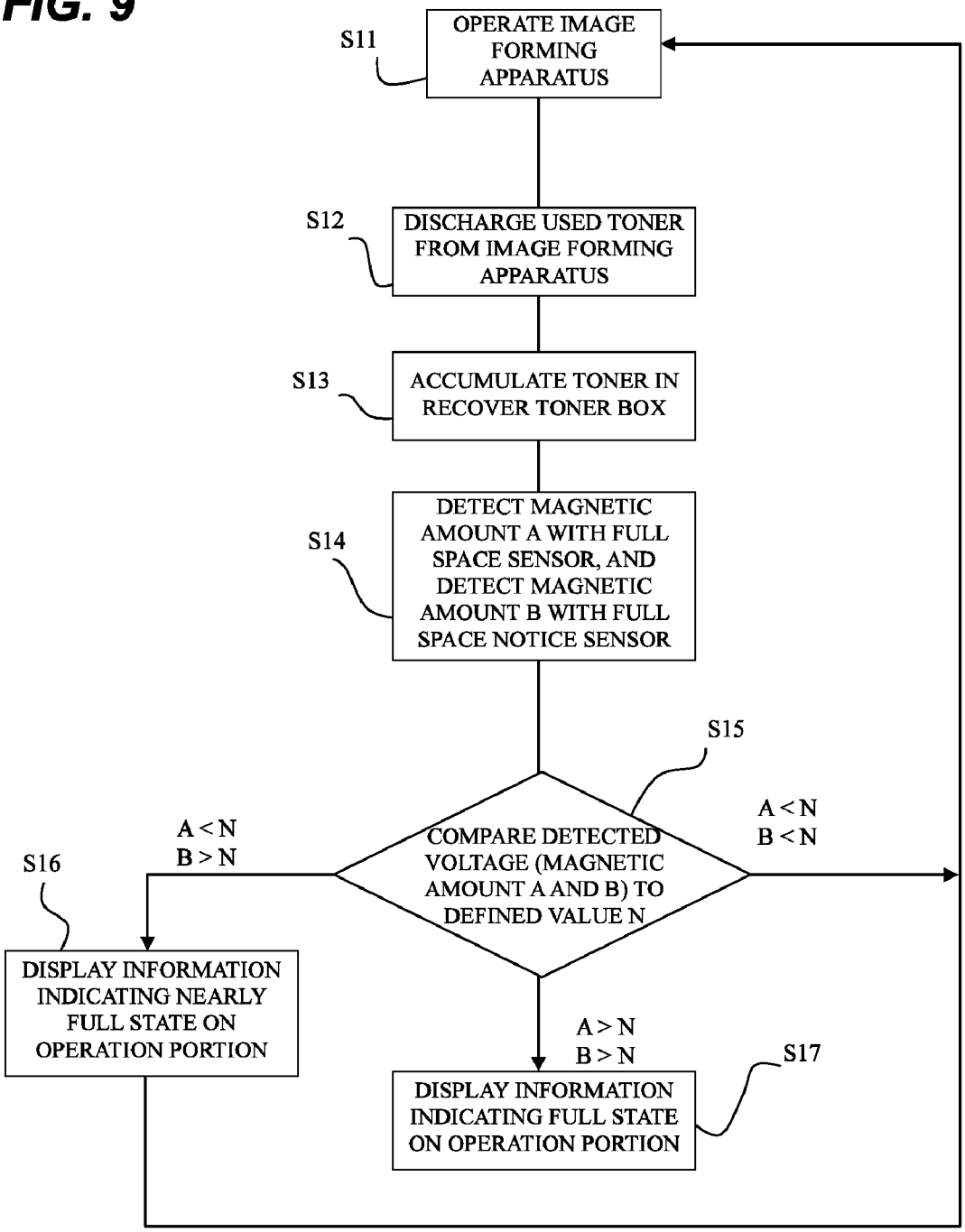
FIG. 9 is a flowchart illustrating an operation for detecting an amount of toner accumulated in the recover toner box.

A flow of an operation for detecting the amount of accumulated toner with the two sensors will be described. FIG. 9 is a flowchart illustrating the operation for detecting the amount of accumulated toner. Referring to FIG. 9, in an operating state of the image forming apparatus (Step S11), the toner used (after the transfer) is discharged from the image forming apparatus (Step S12). The toner is recovered in the recover toner box 120 through the recover toner pipe 119 (Step S13). As described above, the recovered toner is accumulated in the recover toner box 120 while the capacity is effectively utilized by the screws 126, 127, and 128 (Step S14). When the sensors 129*a* and 129*b* respectively detect the magnetic quantities A and B (Step S15), the detected magnetic quantities are converted into the detection voltages. The detection voltages are compared to the predetermined specified value N to determine the amount of toner accumulated in the recover toner box 120. When the detection voltage (magnetic quantity B) of the full space notice sensor 129*b* is more than the specified value N (B>N) and, at the same time, when the detection voltage (magnetic quantity A) of the full space sensor 129*a* is lower than the specified value N (A<N), that the toner amount approaches the capacity of the recover toner box 120 is displayed on the operation portion of the image forming apparatus (Step S16). When the detection voltage (magnetic quantity B) of the full space notice sensor 129*b* is more than the specified value N (B>N) and, at the same time, when the detection voltage (magnetic quantity A) of the full space sensor 129*a* is more than the specified value N (A>N), that the recover toner box 120 is filled up with the toner is displayed on the operation portion of the image forming apparatus (Step S17) When the detection voltage (magnetic quantity B) of the full space notice sensor 129*b* is lower than the specified value N (B<N) and, at the same time, when the detection voltage (magnetic quantity A) of the full space sensor 129*a* is lower than the specified value N (A<N), the recover toner box 120 is not filled up with the toner, nor approaches the toner amount the capacity of the recover toner box 120. Therefore, the flow returns to Step S11 to continue the operating state of the image forming apparatus.

In the embodiment, the two toner detecting sensors are provided to detect the amount of accumulated toner and the flow of the control thereof is described. However, the invention is not limited to the embodiment. For example, only the toner detecting sensor for detecting the full space may be used.

Figure 10:
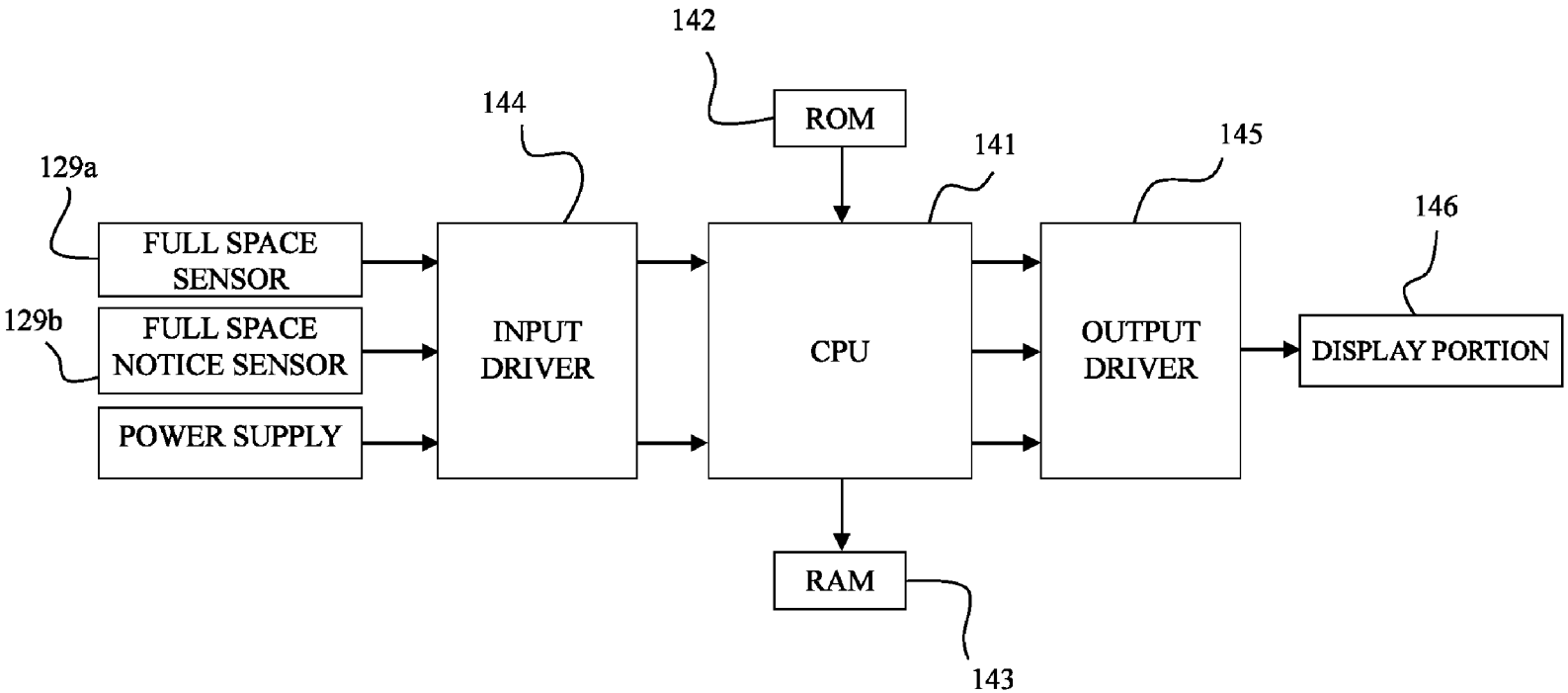
FIG. 10 is a control block diagram.

FIG. 10 illustrates a control block. As illustrated in FIG. 10, ROM 142 is used to store pieces of information such as full-space condition. The pieces of information obtained from the full space sensor 129*a* and the full space notice sensor 129*b* are transmitted from an input driver 144 and temporarily stored in RAM 143. Using the pieces of information stored in ROM 142 and RAM 143, CPU 141 determines whether the accumulation of the toner in the recover toner box 120 is continued or the guide for the exchange of the recover toner box 120 is displayed on the operation portion 146, and CPU 141 supplies the determination result to an output driver 145.

As described above, in the embodiment, the amount of accumulated toner can be detected within a range in which the screws in the recover toner box are not burdened by the accumulation of the recovered toner. That is, the false detection of the amount of toner accumulated in the recover toner box can be prevented, and the accommodation space of the toner box can effectively be utilized.

In the embodiment, the copying machine is described as the image forming apparatus by way of example. The invention is not limited to the copying machine. For example, the invention may be applied to other pieces of image forming apparatus such as a printer, a facsimile, and a copying machine in which the functions of the printer and facsimile are combined. The same effect can be obtained when the invention is applied to the recover toner box of the pieces of image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-190888, filed Jul. 24, 2008, which is hereby incorporated by reference herein in its entirety.

What is claimed is:

1. An image forming apparatus comprising:

an image forming portion that forms a toner image;

a container that is detachably attached to a main body of the image forming apparatus to accommodate toner discharged from the image forming portion;

an inflow port that is provided on a side of one end in a longitudinal direction of the container and on a central portion in a width direction of the container, the toner discharged from the image forming portion being caused to flow in the container through the inflow port;

a first conveying member that is provided in the container, the first conveying member including a conveying portion that conveys the toner flowing through the inflow port from the one end toward an other end;

a second conveying member and a third conveying member that are provided rotatably in the container at both sides of the first conveying member respectively, the second conveying member and the third conveying member including a conveying portion that conveys the toner conveyed by the first conveying member from the other end toward the one end; and a sensor disposed at a downstream side in a toner conveying direction of at least one of the second conveying member or the third conveying member, the sensor detecting toner contained in the container.

2. An image forming apparatus according to claim 1, wherein each conveying portion of the second conveying member and the third conveying member is a blade in spiral shape formed around a rotary shaft, and the blade is not formed at a facing portion of the at least one of the second conveying member or the third conveying member where the sensor is facing to a side of the rotary shaft of the at least one of the second conveying member or the third conveying member.

* * * * *